US007610969B2

(12) United States Patent
LaGrange et al.

(10) Patent No.: US 7,610,969 B2
(45) Date of Patent: Nov. 3, 2009

(54) PERFORATING METHODS AND DEVICES FOR HIGH WELLBORE PRESSURE APPLICATIONS

(75) Inventors: Timothy Edward LaGrange, Rainbow, TX (US); Dan W. Pratt, Fort Worth, TX (US); Jeffrey Michael West, Benbrook, TX (US); Lesley Alan Weisner, Granbury, TX (US); Christopher Hoelscher, Arlington, TX (US)

(73) Assignee: Owen Oil Tools LP, Houston, TX (US)

( * ) Notice: Subject to any disclaimer, the term of this patent is extended or adjusted under 35 U.S.C. 154(b) by 172 days.

(21) Appl. No.: 11/753,200

(22) Filed: May 24, 2007

(65) Prior Publication Data

US 2008/0011483 A1 Jan. 17, 2008

Related U.S. Application Data

(60) Provisional application No. 60/808,758, filed on May 26, 2006.

(51) Int. Cl.
*E21B 43/117* (2006.01)

(52) U.S. Cl. ..... 175/4.6; 166/297; 166/55; 166/55.1

(58) Field of Classification Search ..... 166/297, 166/55, 55.1; 175/4.6
See application file for complete search history.

(56) References Cited

U.S. PATENT DOCUMENTS

| | | | |
|---|---|---|---|
| 2,649,046 | A | 8/1953 | Davis |
| 2,749,840 | A | 6/1956 | Babcock |
| 2,750,885 | A | 6/1956 | Schlumberger |
| 2,968,243 | A | 1/1961 | Turechek |
| 2,980,017 | A | 4/1961 | Castel |
| 3,211,093 | A | 10/1965 | McCullough et al. |
| 3,321,965 | A | 5/1967 | Johnson et al. |
| 3,453,960 | A | 7/1969 | Qualls |
| 3,486,410 | A | 12/1969 | Drexelius et al. |
| 3,688,988 | A | 9/1972 | Howison et al. |
| 3,698,281 | A | 10/1972 | Brandt et al. |
| 4,253,523 | A | 3/1981 | Ibsen |
| 4,393,946 | A | 7/1983 | Pottier et al. |
| 4,467,787 | A | 8/1984 | Ueda |
| 4,523,649 | A | 6/1985 | Stout |
| 4,537,255 | A | 8/1985 | Regalbuto et al. |
| 4,633,951 | A | 1/1987 | Hill et al. |
| 4,683,943 | A | 8/1987 | Hill et al. |
| 4,685,376 | A | 8/1987 | Noel et al. |
| 4,718,493 | A | 1/1988 | Hill et al. |

(Continued)

*Primary Examiner*—Giovanna C Wright
(74) *Attorney, Agent, or Firm*—Mossman Kumar & Tyler PC

(57) ABSTRACT

A carrier tube for use in a wellbore perforating gun has inner and outer layers selected from materials of different, comparative physical properties. The inner layer has a higher compressive strength, and the outer layer has a higher yield strength. The inner layer enables the tube to withstand wellbore compressive pressures, which may, depending upon the material selected, include relatively high pressures, while the outer layer contains any fragments of the inner layer that result upon detonation of the gun. It is emphasized that this abstract is provided to comply with the rules requiring an abstract which will allow a searcher or other reader to quickly ascertain the subject matter of the technical disclosure. It is submitted with the understanding that it will not be used to interpret or limit the scope or meaning of the claims.

18 Claims, 3 Drawing Sheets

U.S. PATENT DOCUMENTS

| | | | | |
|---|---|---|---|---|
| 4,778,009 | A | 10/1988 | Sumner et al. | |
| 4,823,875 | A | 4/1989 | Hill | |
| 4,885,993 | A | 12/1989 | Hancock et al. | |
| 4,889,183 | A | 12/1989 | Sommers et al. | |
| 4,901,802 | A | 2/1990 | George et al. | |
| 4,905,759 | A | 3/1990 | Wesson et al. | |
| 4,958,569 | A | 9/1990 | Mandigo | |
| 5,044,437 | A | 9/1991 | Wittrisch | |
| 5,095,999 | A | 3/1992 | Markel | |
| 5,098,487 | A | 3/1992 | Brauer et al. | |
| 5,148,868 | A | 9/1992 | Christian | |
| 5,303,772 | A | 4/1994 | George et al. | |
| 5,318,126 | A | 6/1994 | Edwards et al. | |
| 5,327,974 | A | 7/1994 | Donovan et al. | |
| 5,366,014 | A | 11/1994 | George | |
| 5,398,760 | A | 3/1995 | George et al. | |
| 5,415,101 | A | 5/1995 | Brinkmann | |
| 5,477,785 | A | 12/1995 | Dieman, Jr. et al. | |
| 5,490,563 | A | 2/1996 | Wesson et al. | |
| 5,509,356 | A | 4/1996 | Renfro | |
| 5,509,481 | A | 4/1996 | Huber et al. | |
| 5,598,891 | A | 2/1997 | Snider et al. | |
| 5,775,426 | A | 7/1998 | Snider et al. | |
| 5,829,538 | A | 11/1998 | Wesson et al. | |
| 5,847,312 | A | 12/1998 | Walters et al. | |
| 5,960,894 | A | 10/1999 | Lilly et al. | |
| 5,988,702 | A | 11/1999 | Sas-Jaworsky | |
| 6,170,400 | B1 | 1/2001 | Salort | |
| 6,250,277 | B1 | 6/2001 | Adamovski et al. | |
| 6,336,506 | B2 | 1/2002 | Wesson | |
| 6,347,673 | B1 | 2/2002 | Dailey | |
| 6,422,148 | B1 | 7/2002 | Xu et al. | |
| 6,520,258 | B1 | 2/2003 | Yang et al. | |
| 6,679,327 | B2 | 1/2004 | Sloan et al. | |
| 6,865,792 | B2 | 3/2005 | Kash | |
| 6,865,978 | B2 | 3/2005 | Kash | |
| 7,159,657 | B2 | 1/2007 | Ratanasirigulchia et al. | |
| 2004/0216633 | A1* | 11/2004 | Kash | 102/320 |
| 2006/0027397 | A1* | 2/2006 | Scott | 175/4.6 |
| 2006/0075889 | A1* | 4/2006 | Walker | 89/1.15 |

* cited by examiner

PERFORATING METHODS AND DEVICES FOR HIGH WELLBORE PRESSURE APPLICATIONS

CROSS-REFERENCE TO RELATED APPLICATIONS

This application claims benefit of and takes priority from 60/808,758 filed on May 26, 2006.

BACKGROUND OF THE DISCLOSURE

1. Field of the Disclosure

The present disclosure relates to devices and methods for perforating a well having high wellbore fluid pressure.

2. Description of the Related Art

Hydrocarbons, such as oil and gas, are produced from cased wellbores intersecting one or more hydrocarbon reservoirs in a formation. These hydrocarbons flow into the wellbore through perforations in the cased wellbore. Perforations are usually made using a perforating gun loaded with shaped charges. The gun is lowered into the wellbore on electric wireline, slickline, tubing, coiled tubing, or other conveyance device until it is adjacent the hydrocarbon producing formation. Thereafter, a surface signal actuates a firing head associated with the perforating gun, which then detonates the shaped charges. Projectiles or jets formed by the explosion of the shaped charges penetrate the casing to thereby allow formation fluids to flow through the perforations and into a production string.

In some of the more recent hydrocarbon exploration and recovery activity, well owners have encountered relatively high fluid pressures in the drilled wellbores; e.g., fluid pressures approaching and exceeding 25,000 PSI. As will be seen, such pressures can be problematic for conventional perforating gun configurations, one of which is shown in FIG. 1. In FIG. 1, there is shown a conventional perforating gun 10 that includes a charge strip or tube 12 positioned in a carrier tube 14. Fixed within the charge tube 12 are shaped charges 18. A detonator cord 16 runs through suitable bores to the shaped charges 18. Connector subs such as a top sub 22, intermediate subs 24, and a bottom sub 26 are used to interconnect the various components making up the gun 10, connect together two or more guns 10, seal the interior 28 of the gun 10 and/or provide a connection point 30 to the conveyance device used to run the gun 10 or gun train into the wellbore.

Conventionally, the gun 10 is a sealed tool, which means that the interior 28 of the gun 10 is at approximately atmospheric pressure, or at least at a pressure substantially lower than the pressure of the wellbore fluid surrounding the gun 10. Typically, the carrier tube 14 is formed of steel or steel alloy, which exhibits suitable compressive strength at pressures below 25,000 PSI. That is, a conventional steel carrier tube 14 resists crushing or catastrophic deformation at pressure below 25,000 PSI. However, for pressures approaching 25,000 PSI, the carrier tube 14 typically incorporates exotic and expensive steel alloys and/or utilizes substantially thick walls. In some cases, the wall thickness required to resist crushing is impractical because it would unduly restrict the space for the shaped charges 18. In other cases, the cost of the perforating gun can become prohibitive.

Prior art gun configurations have utilized non-steel components. For example, U.S. Pat. No. 6,865,792 relates to methods for making a perforating gun that involves, in part, forming a carrier tube having multiple layers. These methods, however, appear to be primarily directed to fabricating a carrier tube at low cost. U.S. Pat. No. 5,829,538 teaches a perforating gun having charge holders and explosive charges that are formed of materials that disintegrate upon detonation of the explosive charges. U.S. Pat. No. 6,422,148 teaches a perforating gun assembly that includes at least one component that is constructed from a composite material and that is impermeable to wellbore fluids. The composite component is designed to shatter into small pieces upon detonation of the perforating gun. Thus, conventional gun arrangements using non-metal components have not addressed the difficulties presented in relatively high-pressure wellbore situations.

The present disclosure addresses these and other drawbacks of the prior art.

SUMMARY OF THE DISCLOSURE

In one aspect, the disclosure provides a carrier tube for use in a wellbore perforating gun. The carrier tube has inner and outer layers selected from materials of comparatively different physical properties. The inner layer has a higher compressive strength, and the outer layer has a higher tensile strength. Selections of materials for each layer may include various steels and steel alloys, hereinafter collectively termed as "steel," non-steel alloys, elemental metals, ceramics, fiber composites, and the like. The inner layer enables the tube to withstand wellbore compressive pressures, which may, depending upon the material selected, include relatively high pressures. At the same time the outer layer captures and contains any fragments of the inner layer that result upon detonation of the gun. The carrier tube, and its associated perforating gun, is thus suitable for a variety of wellbore conditions and reduces the need for cleanup work following its use.

In another aspect, the disclosure provides a carrier tube for a wellbore perforating gun, comprising a tubular core and a retention element surrounding the tubular core. In this aspect the tubular core is formed of a material that breaks into fragments upon application of an explosive force from within the carrier tube. The retention element is substantially transparent to compressive forces applied by a wellbore fluid pressure external to the carrier tube. The retention element "contains," i.e., holds, the fragments of the tubular core during and after the application of an explosive force from within the carrier tube, thus enabling removal of at least a majority of the fragments from the wellbore at the same time as the perforating gun as a whole is extracted.

In yet another aspect the disclosure provides an apparatus for perforating a wellbore. This apparatus comprises a charge tube; a plurality of shaped charges affixed in the charge tube; a detonator cord energetically coupled to each shaped charge; and a carrier tube having an interior bore for receiving the charge tube. The carrier tube comprises a radially inner layer; and a radially outer layer. The radially inner layer has a higher compressive strength than the radially outer layer and the radially outer layer has a higher tensile strength than the radially inner layer.

In aspects, the present disclosure provides a method for perforating a wellbore in a relatively high pressure wellbore environment using a wellbore perforating gun. In one embodiment, the method includes positioning at least one shaped charge of the wellbore perforating gun in a tubular core and surrounding the tubular core with a retention element. The retention element may be substantially transparent to compressive forces applied by a wellbore fluid pressure external to the carrier tube, and captures or contains at least one fragment of the tubular core after the detonation of the at least one shaped charge. An exemplary deployment includes conveying the wellbore perforating gun into the wellbore, firing the wellbore perforating gun, and retrieving the wellbore perforating gun.

It should be understood that examples of the more important features of the disclosure have been summarized rather broadly in order that detailed description thereof that follows may be better understood, and in order that the contributions to the art may be appreciated. There are, of course, additional features of the disclosure that will be described hereinafter and will form the subject of the claims appended hereto.

BRIEF DESCRIPTION OF THE DRAWINGS

For detailed understanding of the present disclosure, references should be made to the following detailed description of the preferred embodiment, taken in conjunction with the accompanying drawings, in which like elements have been given like numerals and wherein.

DESCRIPTION OF THE DISCLOSURE

Figure 1:
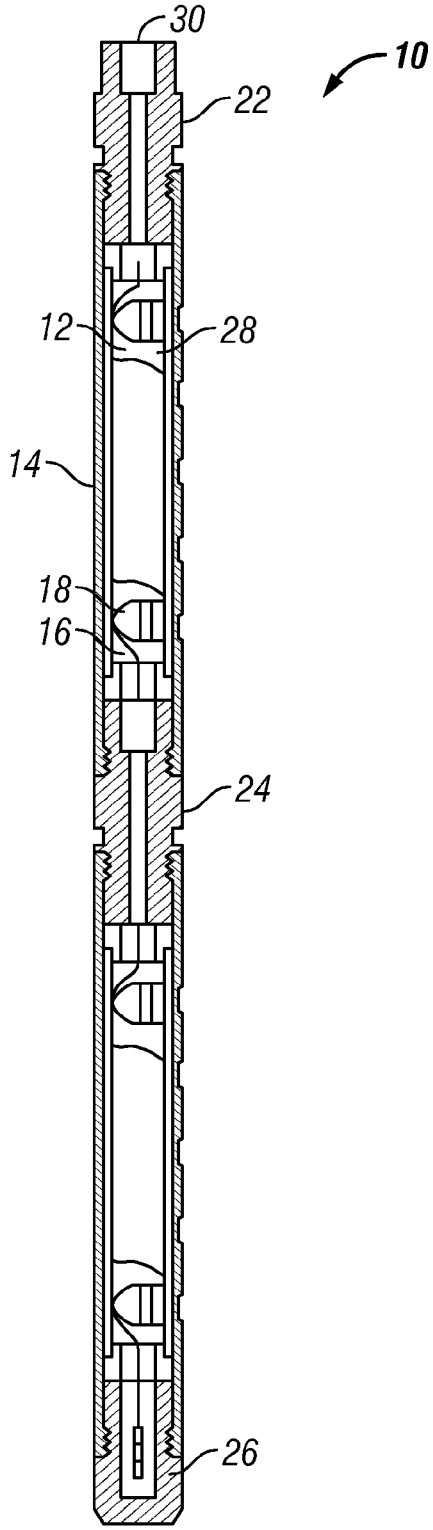
FIG. 1 (Prior Art)
FIG. 1 schematically illustrates a conventional perforating gun train.

The present disclosure relates to devices and methods for perforating a wellbore having relatively high wellbore pressures. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein.

Figure 2:
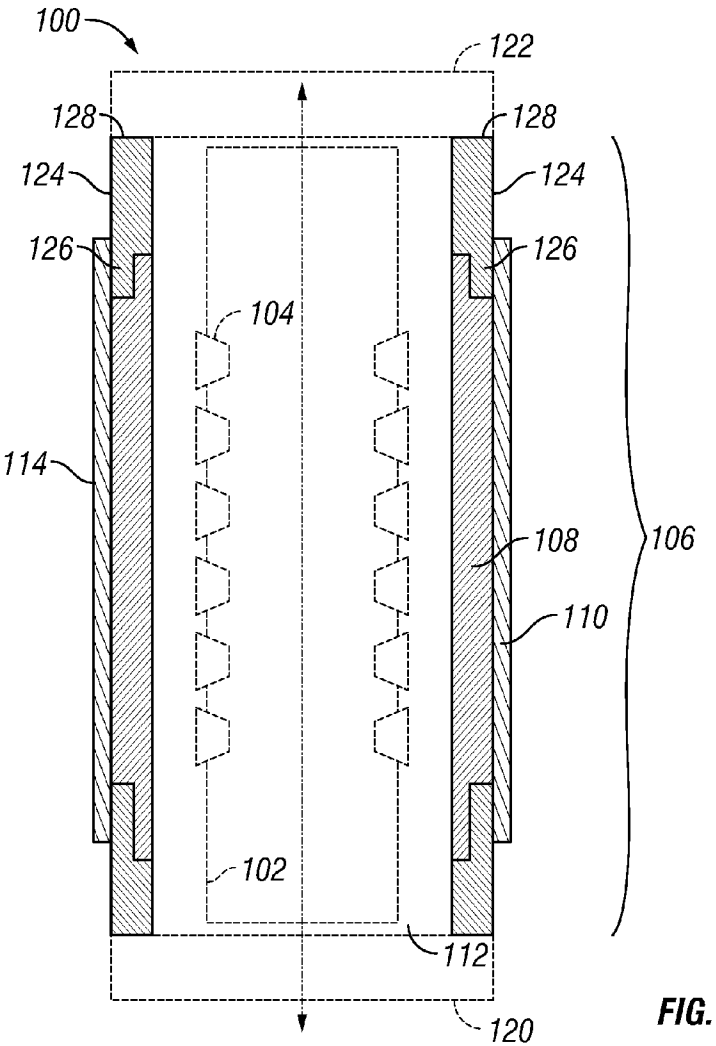
FIG. 2 schematically illustrates one embodiment of a carrier tube according to the present disclosure.

Referring now to FIG. 2, there is shown one embodiment of a perforating gun 100 in accordance with the present disclosure. In a conventional manner, the gun 100 includes a charge holding member such a strip or tube 102, shaped charges 104 and other known components such as a detonator cord (not shown). Advantageously, the gun 100 includes a non-metal carrier tube 106 formed of a material or materials having sufficient compressive yield strength and tensile strength to withstand elevated wellbore pressures and/or the impact forces associated with detonation. Exemplary embodiments of the carrier tube 106 are discussed below.

In one embodiment, the carrier tube 106 includes a plurality of discrete structural elements that cooperate to withstand elevated wellbore pressures and retain structural cohesion of the carrier tube 106 during and after detonation of the shaped charges 104. In one arrangement, the carrier tube 106 includes an inner core or layer 108 formed of a material having a relatively higher compressive strength than that of the outer layer 110, and an outer sleeve or layer 110 having a relatively higher tensile strength than that of the inner core or layer 108. For example, the inner layer 108 may be formed of a ceramic and the outer layer 110 may be formed of a carbon fiber composite material.

During deployment of the gun 100 in a wellbore, the interior 112 of the gun remains substantially at atmospheric pressure whereas the exterior surfaces 114 of the carrier tube 106 are subjected to ambient fluid pressure (e.g., hydrostatic pressure). The resulting pressure differential causes compressive forces to bear upon the exterior surfaces 114. The outer layer 110, however, transfers a substantial portion of the compressive forces to the inner layer 108, which possesses higher compressive strength. In this regard, the outer layer 110 may be considered to be substantially transparent to compressive forces. Thus, due to the higher compressive strength of the inner layer 108, the carrier tube 106 has the structural rigidity that allows the gun 100 to withstand high wellbore pressures. Materials having relatively high compressive strength, such as some ceramics, may tend to fracture when subjected to tensile loadings. The fracture may be as small as a hairline crack or cause fragmentation of the inner layer. Thus, during detonation of the shaped charges 104, the inner layer 108 may crack or shatter. Advantageously, the outer layer 110 has sufficient tensile strength to survive the explosive burst pressures caused by the detonation, while still allowing the explosive force of the detonation to reach the formation. Because the outer layer 110 does not shatter but, rather, perforates during detonation, leaving a majority of it substantially intact, the outer layer 100 may function as an envelope or containment device that captures, i.e., contains or holds, the fractured inner layer 108 within the gun 100 and maintains a physical connection between adjacent components such as the bottom sub 120 and tandem sub 122. As should be appreciated, the gun 100, with its constituent components essentially contained within the outer layer 100, may then be extracted from the wellbore after the perforation activity.

Referring still to FIG. 2, modular joints 124 connect the carrier tube 106 to the gun 100. In one embodiment, the modular joint 124 is formed as a metal sleeve having a first end 126 that couples to the carrier and a second end 128 that couples to a connector sub 120 or 122 or other gun component. In one arrangement, the inner layer 108 is chemically bonded to the first end 126 with a suitable epoxy, glue or resin. In other arrangements, a mechanical joint such as a threaded coupling may be utilized. Additionally, the outer layer 108 overlaps the first end 126 sufficiently to also form a bond or connection with the modular joint 124. For reasons earlier stated, the connection between the outer layer 108 and the modular joint 124 should be sufficiently strong to survive detonation. Suitable means for this connection include chemical connections using glues, epoxies or resins, and/or mechanical connections such as a compression band. The second end 128 may be configured as needed to mate with a selected gun configuration.

It should be appreciated that, in addition to compressive and tensile strength, other material characteristics may be varied or optimized for each element, 108 and 110. For example, if the inner layer 108 is relatively porous, then the outer layer 110 may include materials or use a configuration that enables the outer layer 110 to be relatively impermeable to fluid infiltration. Configuring the outer layer 110 to operate effectively as a sealing layer may also reduce the risk of fluid invading the interior of the gun at the connection point between the modular joint 124 and the inner layer 108.

Figure 3:
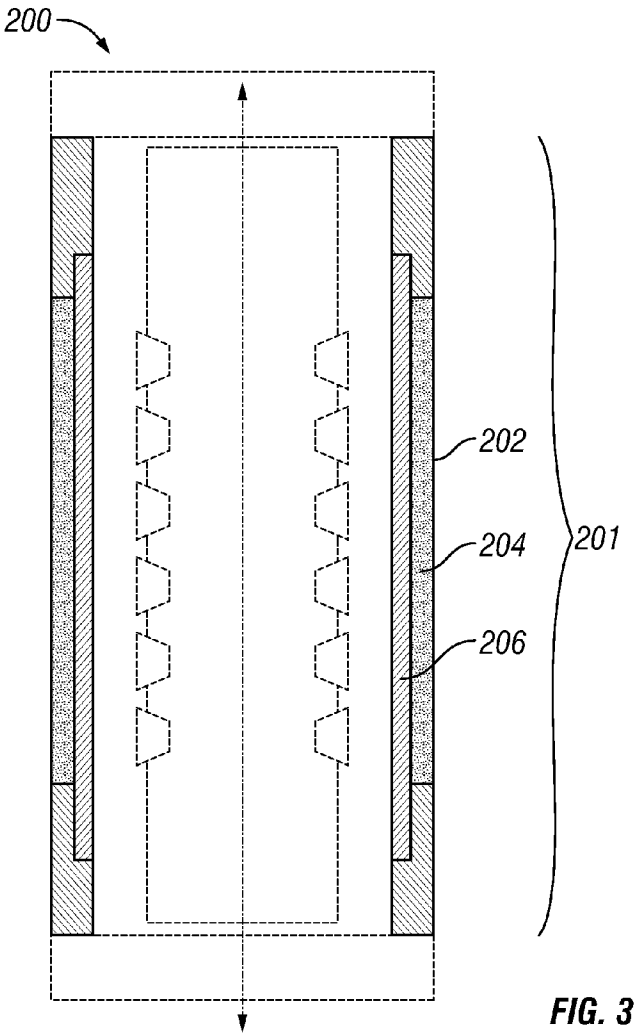
FIG. 3 schematically illustrates another embodiment of a carrier tube according to the present disclosure.

Referring now to FIG. 3, there is shown another embodiment of a perforating gun 200 made in accordance with the present disclosure. The carrier tube 201 includes a unitary body 202 formed of multiple structural elements 204 and 206. The radially inner element 206 is formed of a material having relatively high compressive strength. The radially outer element 204 may be formed by chemically, thermally or mechanically altering the outer surface of the inner element 206 to obtain a relatively high tensile strength. Of course, more than two discrete elements may be used. For example, intermediate layers may be used to accommodate distortion such as that due to thermal expansion.

Figure 4:
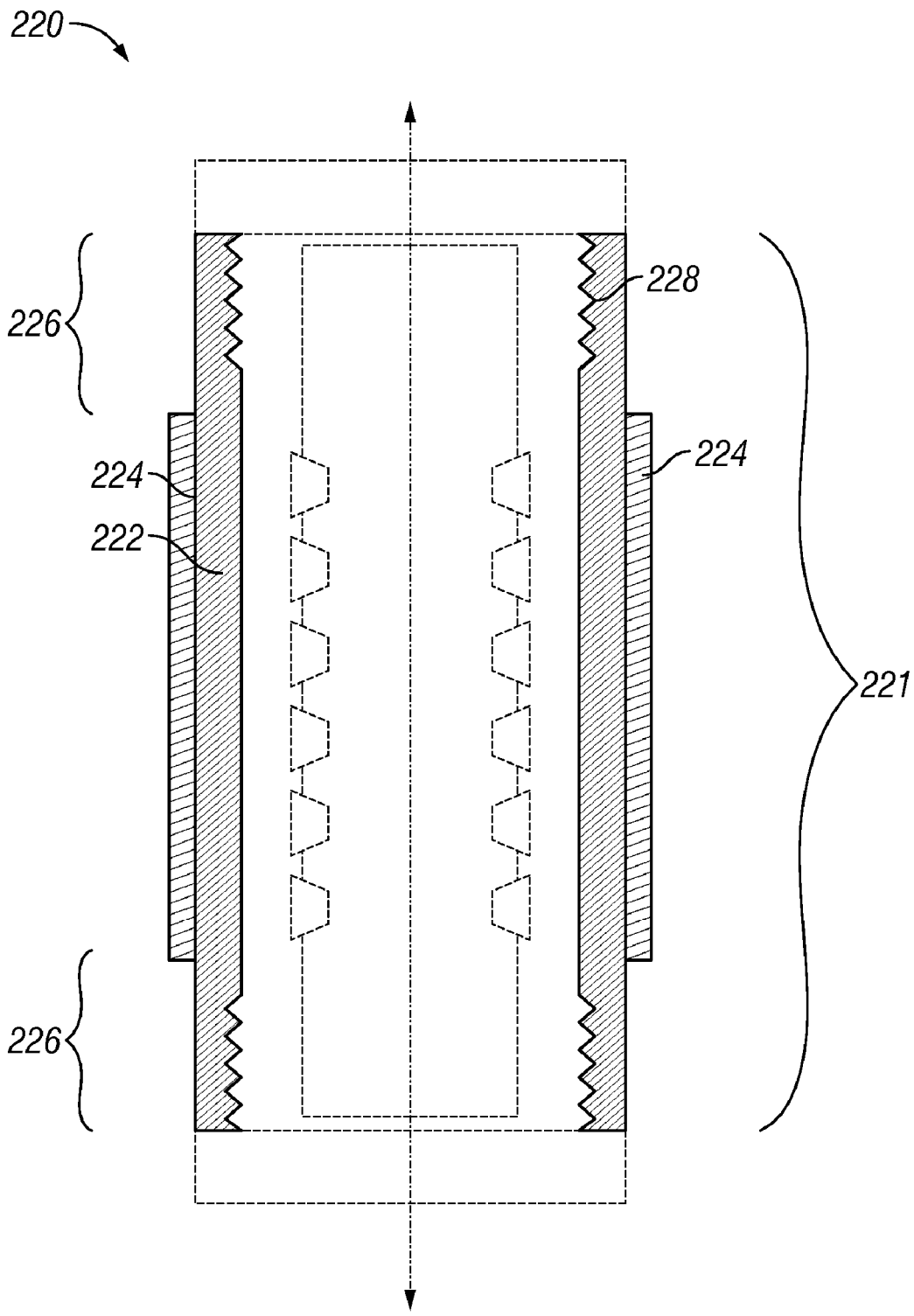
FIG. 4 schematically illustrates yet another embodiment of a carrier tube according to the present disclosure.

Referring now to FIG. 4, there is shown an embodiment of a perforating gun 220 that utilizes one or more steel components in a manner suitable for high-pressure well operations. The gun 220 includes a carrier tube 221 having an inner core or layer 222 having one or more material properties selected to withstand a pressure differential between the interior and exterior of the gun 220 and an outer sleeve or layer 224 can contain a fractured inner layer 222 in a manner that the fractured inner layer 222 can be retrieved to the surface. In one embodiment, the inner core or layer 222 is formed of a steel having relatively high compressive strength and an outer sleeve or layer 224 is formed of a material having a relatively high tensile strength. For example, the inner layer 222 may be a steel tube having selectively varied material properties. In one embodiment, the inner layer 222 uses a steel having a hardness, i.e., compressive strength, sufficient to withstand high wellbore pressures. However, as is known, steel having such high hardness, referred to herein as relatively high hardness steel, may be difficult to machine and may fracture upon detonation of the charges or if mishandled (e.g., dropped or hit with an object). Advantageously, the ends 226 of the inner layer 222 are heat treated to reduce the hardness to a level such that threads 228 or other connection mechanisms may be readily machined on the ends 226. Thus, in such an embodiment, a material property such as hardness, ductility or yield strength is varied across the length of the inner layer 222. The outer layer 224 may be formed of a carbon fiber composite material.

In general, suitable materials for the outer layer may include, for example, fibers of carbon, glass, silica, graphite, KEVLAR™, NOMEX™, and/or ARAMID™, and other materials made from combinations of fibers and matrix materials. Coated fibers are also included within the scope of this disclosure. Other suitable materials include polymers (such as thermosets and thermoplastics), ceramics, steels, steel alloys, non-steel alloys, elemental metals, and intermetallics. For example, the fiber composite material may be constructed from glass and/or carbon fibers with epoxy as a matrix material. The fibers may be embedded in a single matrix material or in a mixture of more than one matrix material. The fibers may be all of one material or include combinations of materials.

Suitable materials for the inner layer may also be selected from the same list as for the outer layer, provided that the relative compressive strength of the inner layer is higher than that of the outer layer and the relative tensile strength of the outer layer is higher than that of the inner layer. In wells exhibiting high wellbore pressures, modified high-strength steels may also be selected and may be particularly effective. Where such a steel is used for the inner layer, detonation may result in formation of burrs, which are areas where the detonation perforation deforms the steel edge surrounding the hole such that it is raised, or protruded, in a radially outward direction, relative to the overall surface of the carrier tube. Such burrs may present problems in extracting the gun from the wellbore, because the burrs may catch on adjacent structures, such as portions of a well casing. This problem may be addressed by combining the modified high-strength steel inner layer with a relatively higher yield strength outer layer, such as a carbon fiber composite material. Such a combination may serve to reduce the protrusion of the burrs, resulting in smaller holes resulting from detonation. It may also reduce the likelihood of burrs catching on adjacent structures such as portions of the well casing. Finally, it may also contain debris such as remnants of the expended charges or any pieces of steel which may be generated if the inner layer shatters during the detonation.

In contrast, steel may also be used for the outer layer in applications wherein high wellbore pressures are not present, but in this case the steel is desirably of a material having a yield strength that is higher than that of the material of the inner layer. For example, a conventional steel, i.e., not high hardness, outer layer may be combined with a ceramic inner layer. In this case the steel outer layer may serve primarily to contain any pieces of the ceramic that may result from detonation. Thus, adaptations of the present disclosure to enable advantageous application to wells exhibiting both high wellbore pressures and lesser pressures, whether or not using steel as a component, may be envisioned by those skilled in the art.

It should be understood that the component terms used herein, such as core or layer, are not intended to imply any particular method of manufacture, shape, material or dimensions.

The foregoing description is directed to particular embodiments of the present disclosure for the purpose of illustration and explanation. It will be apparent, however, to one skilled in the art that many modifications and changes to the embodiment set forth above are possible without departing from the scope of the disclosure. It is intended that the following claims be interpreted to embrace all such modifications and changes.

The invention claimed is:

1. An apparatus for perforating a wellbore, comprising:

(a) a charge holding member;

(b) a plurality of shaped charges affixed in the charge holding member;

(c) a detonator cord energetically coupled to each shaped charge; and (d) a carrier tube having an interior bore for receiving the charge holding member, the interior bore being substantially pressure sealed, the carrier tube comprising:

(i) a radially inner layer configured to withstand a pressure differential between the interior bore and an exterior of the carrier tube; and (ii) a radially outer layer, wherein the radially outer layer has a higher tensile strength than the radially inner layer, the tensile strength of the radially outer layer being selected to allow the radially outer layer to transfer substantially all of a compressive force associated with the pressure differential to the radially inner layer.

2. The apparatus according to claim 1, wherein the radially inner layer is formed at least partially with of one of: (i) an elemental metal; (ii) a non-steel alloy; (iii) a ceramic; and (iv) a fiber composite material.

3. The apparatus according to claim 1, wherein the radially inner layer is formed of a steel.

4. The apparatus according to claim 1, wherein the radially outer layer is formed at least partially of with one of: (i) a steel; (ii) an elemental metal; (iii) a non-steel alloy; (iv) a ceramic; and (v) a fiber composite material.

5. The apparatus according to claim 1, wherein the radially outer layer is formed of a fiber composite material having fibers formed of at least one of: (i) carbon, (ii) glass, (iii) silica, and (iv) graphite.

6. The apparatus according to claim 1, wherein the radially inner layer is porous and the radially outer layer is non-permeable, and wherein the radially outer layer is in contacting communication with at least a portion of the radially inner layer such that the radially outer layer seals the portion of the radially inner layer.

7. The apparatus according to claim 6, wherein the contacting communication is at least one of: (i) an adhesive bond; and (ii) a mechanical connection.

8. The apparatus according to claim 6, wherein the radially outer layer is formed as a sleeve over the radially inner layer.

9. The apparatus according to claim 1, wherein the radially outer layer contains at least a portion of the radially inner layer during and after detonation of the shaped charges.

10. The apparatus according to claim 1, wherein the radially inner layer is able to withstand wellbore compressive forces external to the radially outer layer.

11. The apparatus according to claim 1, wherein the radially inner layer has a higher compressive strength than the radially outer layer.

12. A carrier tube for a wellbore perforating gun, comprising:

a porous tubular core;

at least one shaped charge positioned inside the tubular core;

a fluid impermeable retention element surrounding the tubular core, wherein the retention element is configured to transfer compressive forces applied by a wellbore fluid pressure external to the carrier tube to the tubular core; and wherein the retention element contains at least one fragment of the tubular core after a detonation of at least one shaped charge inside the tubular core; and at least two adjacent components of the perforating gun coupled to one another by the retention element.

13. The carrier tube according to claim 12, wherein the tubular core has a higher compressive strength than the retention element.

14. The carrier tube according to claim 12, wherein the retention element is formed at least partially of a fiber composite material.

15. A method for perforating a wellbore in a relatively high pressure wellbore environment using a wellbore perforating gun, comprising:

positioning at least one shaped charge of the wellbore perforating gun in a porous tubular core; and surrounding and sealing tubular core with a fluid impermeable retention element;

transferring substantially all of the compressive forces applied by a wellbore fluid pressure external to the carrier tube to the tubular core using the retention element;

containing within the retention element at least one fragment of the tubular core after the detonation of the at least one shaped charge; and connecting an upper component of the perforating gun to a lower component of the perforating gun using the retention element after detonating the at least one shaped charge.

16. The method according to claim 15, further comprising forming the retention element at least partially with of one of: (i) a steel; (ii) an elemental metal; (iii) a non-steel alloy; (iv) a ceramic; and (v) a fiber composite material.

17. The method according to claim 15, wherein the retention element has a higher compressive strength than the tubular core.

18. The method according to claim 15, further comprising: conveying the wellbore perforating gun into the wellbore; fragmenting the tubular core by firing the wellbore perforating gun; containing at least one fragment of the tubular core within the retention element and retrieving the wellbore perforating gun.

* * * * *